US007002521B2

(12) United States Patent
Egawa et al.

(10) Patent No.: US 7,002,521 B2
(45) Date of Patent: Feb. 21, 2006

(54) ANTENNA DEVICE FOR RADIO APPARATUS

(75) Inventors: Kiyoshi Egawa, Minato-ku (JP); Hideo Ito, Machida (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 125 days.

(21) Appl. No.: 10/475,837

(22) PCT Filed: Feb. 27, 2003

(86) PCT No.: PCT/JP03/02175

§ 371 (c)(1),
(2), (4) Date: Oct. 24, 2003

(87) PCT Pub. No.: WO03/073553

PCT Pub. Date: Sep. 4, 2003

(65) Prior Publication Data

US 2004/0130492 A1 Jul. 8, 2004

(30) Foreign Application Priority Data

Feb. 27, 2002 (JP) ..... 2002-051286

(51) Int. Cl.
*H01Q 1/24* (2006.01)

(52) U.S. Cl. ..... 343/702

(58) Field of Classification Search ..... 343/702, 343/700 MS, 833, 834, 817, 818, 815, 819, 343/841; 455/78
See application file for complete search history.

(56) References Cited

U.S. PATENT DOCUMENTS

| | | | | |
|---|---|---|---|---|
| 6,211,830 | B1 * | 4/2001 | Monma et al. | 343/702 |
| 6,288,682 | B1 * | 9/2001 | Thiel et al. | 343/702 |
| 6,563,467 | B1 * | 5/2003 | Buris et al. | 343/702 |
| 6,781,556 | B1 * | 8/2004 | Kojima et al. | 343/818 |
| 2004/0032370 | A1 * | 2/2004 | Ito et al. | 343/702 |

FOREIGN PATENT DOCUMENTS

| | | |
|---|---|---|
| EP | 1154513 A1 | 11/2001 |
| JP | 05037218 | 2/1993 |
| JP | 08195609 | 7/1996 |
| JP | 11004113 | 1/1999 |
| JP | 11274845 | 10/1999 |
| JP | 2000004120 | 1/2000 |
| JP | 2000278025 | 10/2000 |
| JP | 2001077611 | 3/2001 |

(Continued)

OTHER PUBLICATIONS

PCT International Search Report dated Apr. 8, 2003.

*Primary Examiner*—Don Wong
*Assistant Examiner*—Huedung X. Cao
(74) *Attorney, Agent, or Firm*—Stevens, Davis, Miller & Mosher, LLP

(57) ABSTRACT

Feed point (101) performs unbalanced feeding to an antenna element (102). A parasitic element (104) is provided near the antenna element (102) and a ground plane (103), approximately parallel to the width direction of the ground plane (103). Moreover, the parasitic element (104) is configured in a length to operate as a director when provided on the side of the body with respect to the ground plane (103) during talk time and in a length to operate as a reflector when provided on the opposite side from the body with respect to the ground plane (103). By this means, it is possible to improve gain and reduce the specific absorption rate (SAR) during talk time.

7 Claims, 12 Drawing Sheets

FOREIGN PATENT DOCUMENTS * cited by examiner

JP 2002009534 1/2002

ANTENNA DEVICE FOR RADIO APPARATUS

TECHNICAL FIELD

The present invention relates to an antenna apparatus for wireless devices and is applicable to, for instance, portable mobile wireless devices.

BACKGROUND ART

FIG. 1 shows an example of antenna configuration for use for portable mobile wireless devices (referred to as portable mobile communication terminals or simply portable communication terminals) typified by portable telephone devices and mobile wireless devices.

FIG. 1 is a configuration diagram of a conventional antenna apparatus. In this drawing, feed point 11 feeds antenna element 12. Antenna element 12 has an arbitrary shape, which may be linear, helical, and flat, and radiates electric waves when fed. Ground plane 13 is a circuit board or the like. The length of the length direction of ground plane 13 varies depending on the frequency band of the system that is used and the models of mobile telephone devices and is about ⅜ wave length in the 800 MHz band.

When an antenna apparatus configured such as above is used, it occurs that the body absorbs electric waves and becomes an obstacle to the electric waves. To quantitatively measure the amount of absorption of electric waves into the body,there is a measure of specific absorption called the specific absorption rate (SAR: Specific Absorption Rate), which is the power of electromagnetic energy absorbed per unit mass. In Japan, the specific absorption rate is not to go beyond the level stipulated in the guideline on specific absorption in ARIB STD-T56.

However, the following problem exists with conventional antenna apparatus. That is, when an antenna element is unbalanced-fed, chassis current runs over ground plane 13 while communication is in progress, and radiation starts from ground plane 13 in a gripping position by the body (the hand, specifically) as a part of the antenna apparatus (unbalanced feeding scheme). The electric waves are absorbed and obstructed by the body, which then results in the problem of reduced gain. Moreover, with conventional antenna apparatus, when the specific absorption rate (SAR) goes over the level according to the guideline on specific absorption, antenna loss is increased and the transmission power of mobile telephone apparatus is decreased, which then results in the problem of narrowed communication area.

DISCLOSURE OF INVENTION

It is therefore an object of the present invention to provide an antenna apparatus for wireless devices that improves gain during talk time and that decreases the specific absorption rate (SAR).

The point of the invention lies in that a parasitic element is provided near an antenna element and a ground plane, that the parasitic element is configured in a length to operate as a reflector when provided so as to be on the side of the head with respect to the ground plane during talk time, and that the parasitic element is configured in a length to operate as a director when provided so as to be on the opposite side from the head with respect to the ground plane.

BEST MODE FOR CARRYING OUT THE INVENTION

With reference to the accompanying drawings now, embodiments of the present invention will be described in detail.

(First Embodiment)

Figure 1:
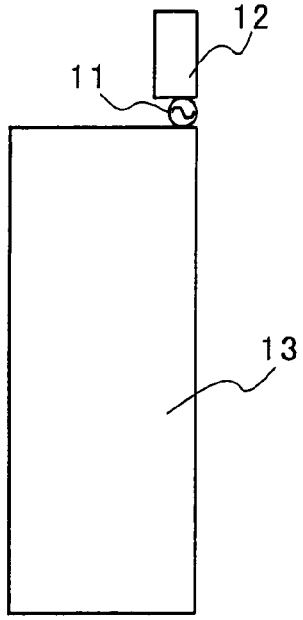
FIG.1 RELATED ART
FIG. 1 is a configuration diagram of a conventional antenna apparatus for wireless devices.
Figure 2:
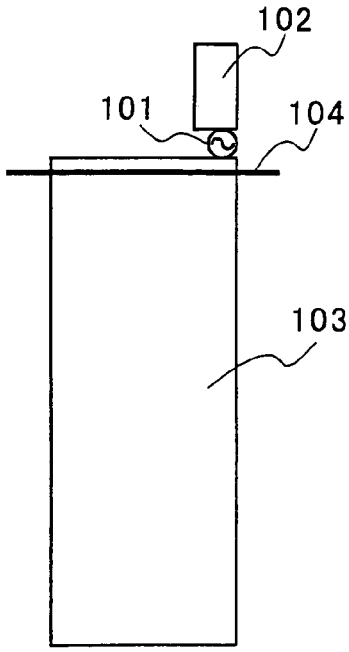
FIG. 2 is a configuration diagram of an antenna apparatus for wireless devices according to the first embodiment of the present invention.

FIG. 2 is a configuration diagram of an antenna apparatus for wireless devices according to the first embodiment of the present invention. Referring to FIG. 2, feed point 101 performs unbalanced feeding to antenna element 102 through predetermined line patterns. Antenna element 102 has an arbitrary shape, which may be linear, helical, flat, and so on. Ground plane 103 is a ground layer configured on a circuit board and has electrically conductive characteristics. Parasitic element 104 is provided near antenna element 102 and ground plane 103, approximately parallel to the width direction of the ground plane. Also, parasitic element 104 is configured in a length to operate as a director when provided so as to be on the side of the human head (hereinafter simply "the body" unless indicated otherwise) with respect to ground plane 103 during talk time, and in a length to operate as a reflector when provided so as to be on the opposite side from the body with respect to ground plane 103.

Next, the operation of the antenna apparatus of the above configuration will be explained. As feed point 101 performs unbalanced feeding to antenna element 102, chassis current runs through ground plane 103, and due to this, radiation occurs from not only antenna element 102 but also from ground plane 103. Then, parasitic element 104 provided approximately parallel to the width direction of the ground plane operates as a director or as a reflector. Generally, when a director is put near a radiator that radiates electric waves (equivalent to ground plane 103), the electric waves will be radiated in the direction of the director. Likewise, when a reflector is put near the radiator, the electric waves will be radiated in the opposite direction from the reflector. Following this principle, it is possible to receive the electrical field that develops from chassis current by means of parasitic element 104 and concentrate electric waves in a specific direction. Then, when parasitic element 104 is placed to be on the side of the body with respect to ground plane 103 during talk time, parasitic element 104 will operate as a reflector. On the other hand, when parasitic element 104 is placed to be on the opposite side from the body with respect to ground plane 103 during talk time, parasitic element 104 will operate as a director. In either case, the direction of radiation will be opposite from the body. FIG. 3 shows these radiation patterns.

Figure 3A:
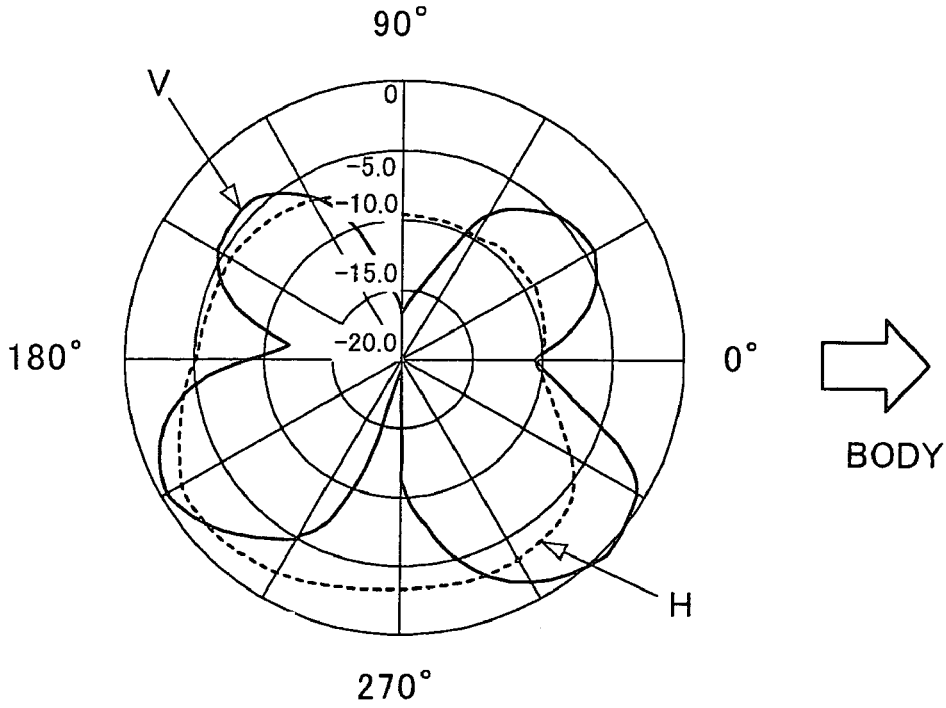
FIG. 3A is a drawing showing a radiation pattern of an antenna apparatus according to the first embodiment of the present invention in free space.
Figure 3B:
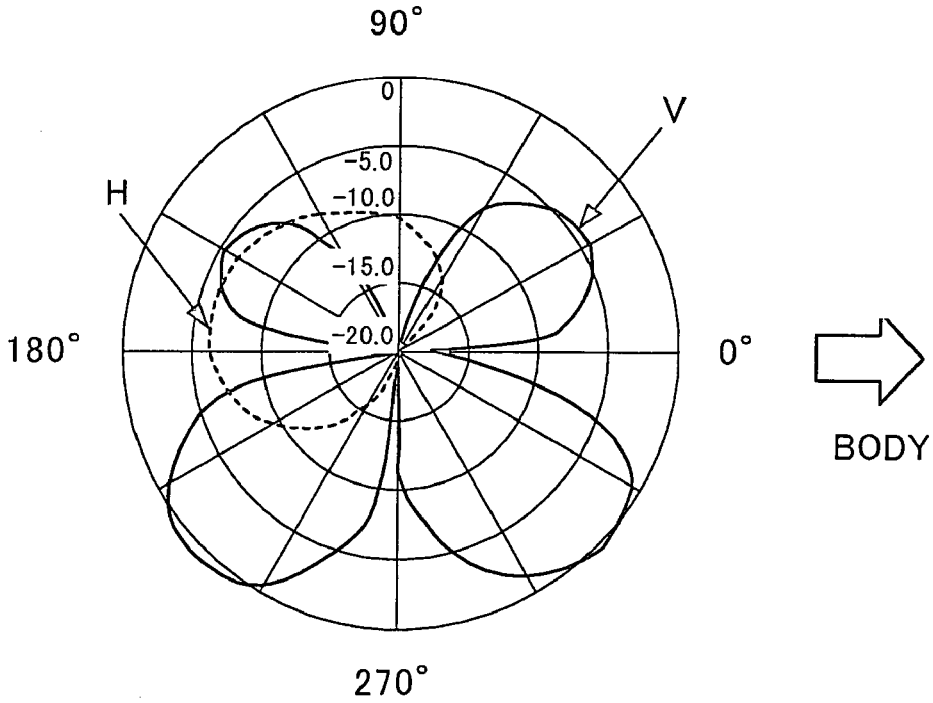
FIG. 3B is a drawing showing a radiation pattern of an antenna apparatus according to the first embodiment of the present invention in free space.

FIGS. 3A and 3B are each a drawing illustrating a radiation pattern of the antenna apparatus in free space according to the first embodiment of the present invention. FIG. 3A shows a radiation pattern where parasitic element 104 is placed to be on the side of the body with respect to ground plane 103 during talk time and operated as a reflector. The pattern shown by the solid line indicates the vertical polarized wave component (V in the drawing), and the pattern shown by the dotted line indicates the horizontal polarized wave component (H in the drawing).

FIG. 3B shows a radiation pattern where parasitic element 104 is placed to be on the opposite side from the body with respect to ground plane 103 during talk time and operated as a director. The patterns shown by the solid line and the dotted line are, as in FIG. 3A, the vertical polarized wave component and the horizontal polarized wave component, respectively. As obvious from the drawings, null points are formed in the direction of the body.

It is obvious that changing the length of the parasitic element changes the radiation pattern. To be more specific, it is possible to reduce radiation to the body side and decrease the specific absorption rate (SAR), and, on the other hand, strengthen radiation to the directions other than the direction of the body, so as to improve gain during talk time.

Thus according to the antenna apparatus for wireless devices of the first embodiment, the parasitic element is provided near the feed point and the ground plane, approximately parallel to the width direction of the ground plane, and the parasitic element is configured in a length to operate as a reflector when provided so as to be on the side of the body during talk time, and in a length to operate as a director when provided so as to be on the opposite side from the body, so that it is possible to improve gain and reduce the specific absorption rate (SAR) during talk time.

(Second Embodiment)

Figure 4:
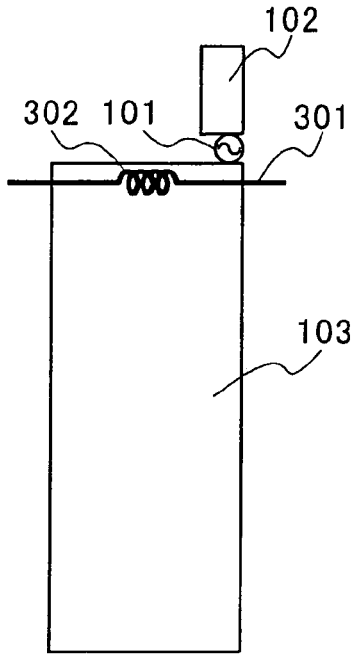
FIG. 4 is a configuration diagram of an antenna apparatus for wireless devices according to the second embodiment of the present invention.
Figure 5:
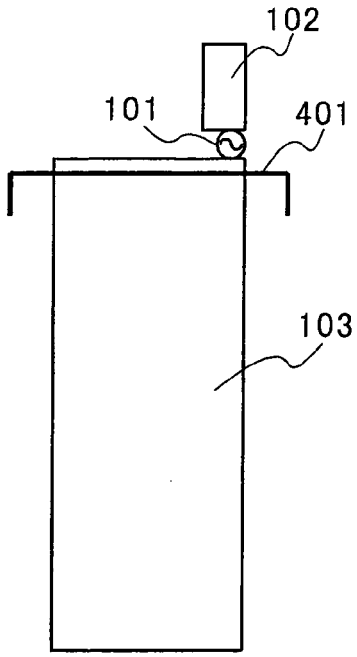
FIG. 5 is a configuration diagram of an antenna apparatus for wireless devices according to the second embodiment of the present invention.
Figure 6:
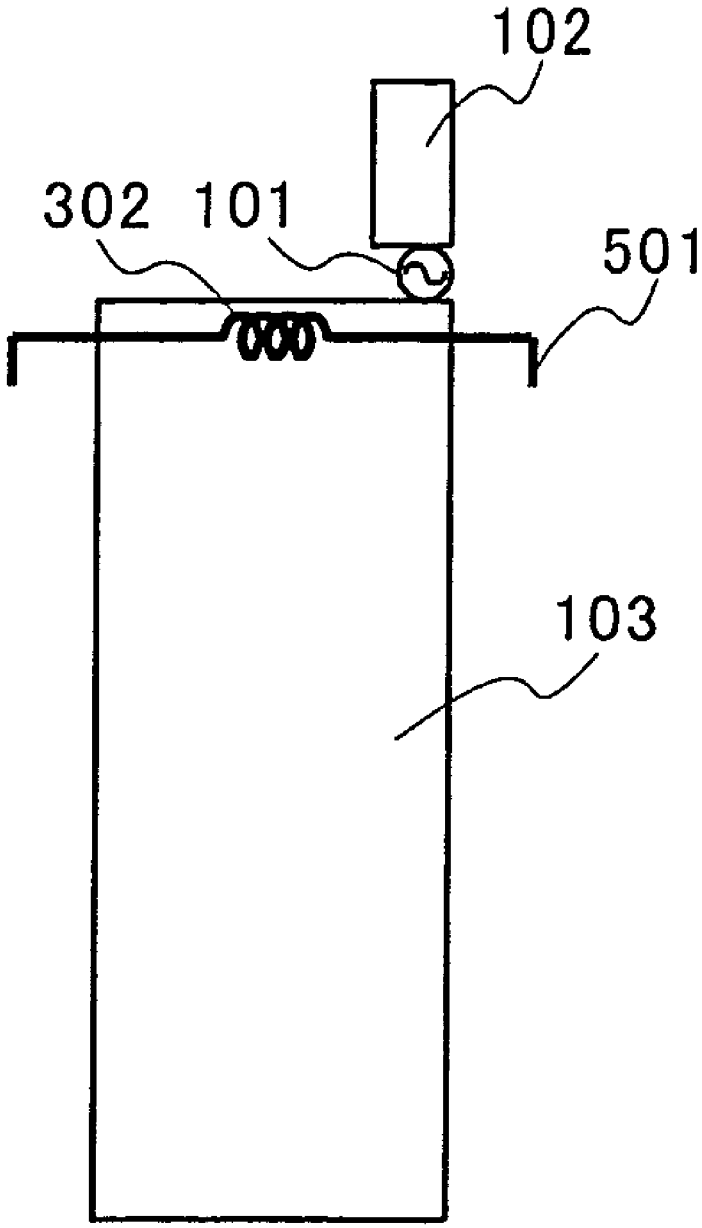
FIG. 6 is a configuration diagram of an antenna apparatus for wireless devices according to the second embodiment of the present invention.

FIG. 4, FIG. 5, and FIG. 6 are each a configuration diagram of an antenna apparatus for wireless devices according to the second embodiment of the present invention. Parts identical to those in FIG. 2 are assigned the same numerals as in FIG. 2 without further explanation.

To use a parasitic element in the antenna apparatus, such a parasitic element is needed that has a predetermined length in accordance with the frequency that is used. Consequently, to make the size of the ground plane and the chassis smaller, work that shortens the length of the parasitic element is required.

Referring to FIG. 4, inductor 302 is installed in the middle of parasitic element 301, so that the element length can be shortened.

Referring to FIG. 5, parasitic element 401 is bent approximately at a right angle at predetermined distance from both ends so as to shorten the length of the width direction and make the configuration simpler than when inductor 302 is installed in the middle of parasitic element 401 as shown in FIG. 4.

Referring to FIG. 6, inductor 302 is installed in the middle of parasitic element 501 and parasitic element 501 is bent at predetermined distance from both ends so as to further shorten the length of the width direction of the ground plane.

In the present embodiment, the parasitic element as shown in FIG. 4–FIG. 6 is configured in a length to operate as a reflector when provided so as to be on the side of the body with respect to ground plane 103 during talk time, and in a length to operate as a director when provided so as to be on the opposite side from the body with respect to ground plane 103 during talk time.

Thus according to the antenna apparatus for wireless devices of the second embodiment, the inductor is installed in the middle of the parasitic element and the parasitic element is bent approximately at a right angle at predetermined distance from both ends, so that, in addition to achieving the effect of the first embodiment, it is possible to shorten the length of the parasitic element in the width direction of the ground plane.

(Third Embodiment)

A case will be described here with the present embodiment where the shapes of the parasitic elements used in the first embodiment and the second embodiment are changed.

Figure 7A:
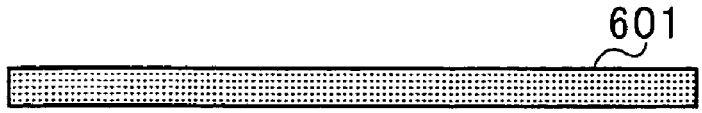
FIG. 7A is a configuration diagram of a parasitic element according to the third embodiment of the present invention.

FIG. 7A to FIG. 7D are each a configuration diagram of a parasitic element according to the third embodiment of the present invention. FIG. 7A shows parasitic element 104 of a linear shape in FIG. 2 changed to parasitic element 601 of a band shape. While changes in the impedance characteristics of linear parasitic element 104 tend to be sharp and make impedance matching difficult, with band-shaped parasitic element 601, changes in the impedance characteristics can be moderated. As a result, it is possible to reduce antenna loss. Moreover, by employing the band shape, the antenna can be configured in a more simple way such as sticking it on a back plane of chassis.

Figure 7B:
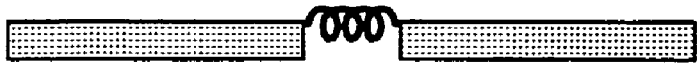
FIG. 7B is a configuration diagram of a parasitic element according to the third embodiment of the present invention.
Figure 7C:
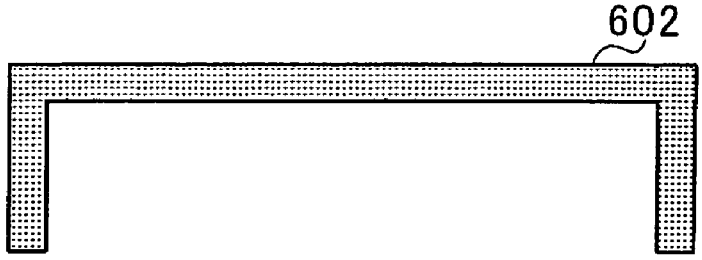
FIG. 7C is a configuration diagram of a parasitic element according to the third embodiment of the present invention.
Figure 7D:
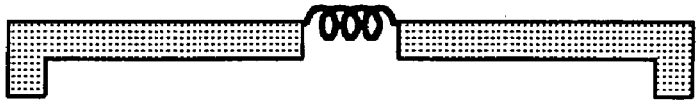
FIG. 7D is a configuration diagram of a parasitic element according to the third embodiment of the present invention.

Similarly, FIG. 7B to FIG. 7D show the linear parasitic elements of FIG. 4 to FIG. 6 changed to band-shaped parasitic elements.

FIG. 8A to FIG. 8D and FIG. 9A to FIG. 9D are each a configuration diagram of a parasitic element according to the third embodiment of the present invention.

Figure 8A:
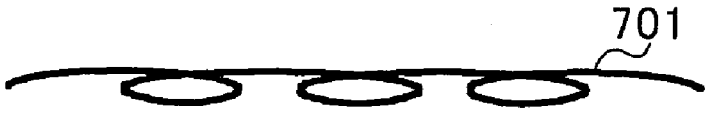
FIG. 8A is a configuration diagram of a parasitic element according to the third embodiment of the present invention.

FIG. 8A shows parasitic element 104 of a linear shape in FIG. 2 changed to parasitic element 701 of a helical shape. With helical parasitic element 701, it is possible to shorten the length that the parasitic element claims in the width direction of the ground plane.

Figure 8B:
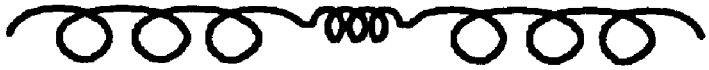
FIG. 8B is a configuration diagram of a parasitic element according to the third embodiment of the present invention.
Figure 8C:
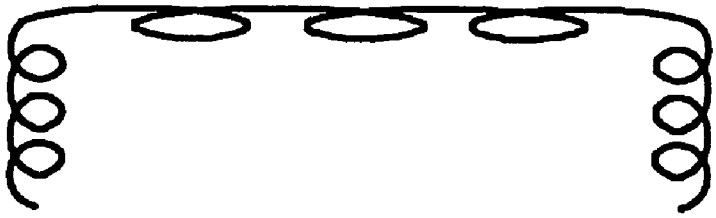
FIG. 8C is a configuration diagram of a parasitic element according to the third embodiment of the present invention.
Figure 8D:
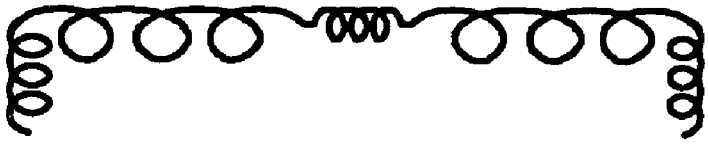
FIG. 8D is a configuration diagram of a parasitic element according to the third embodiment of the present invention.

Similarly, FIG. 8B to FIG. 8D show the linear parasitic elements of FIG. 4 to FIG. 6 changed to helical parasitic elements.

Figure 9A:
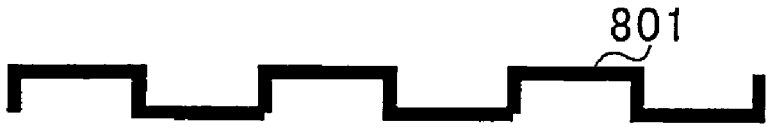
FIG. 9A is a configuration diagram of a parasitic element according to the third embodiment of the present invention.

FIG. 9A shows parasitic element 104 of a linear shape in FIG. 2 changed to parasitic element 801 of a meander shape, and with meander shaped parasitic element 801, it is possible to shorten the length that the parasitic element claims in the width direction of the ground plane.

Figure 9B:
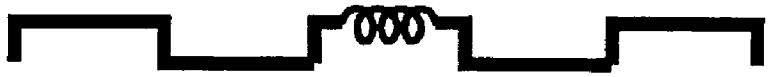
FIG. 9B is a configuration diagram of a parasitic element according to the third embodiment of the present invention.
Figure 9C:
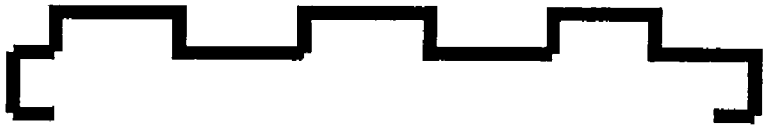
FIG. 9C is a configuration diagram of a parasitic element according to the third embodiment of the present invention.
Figure 9D:
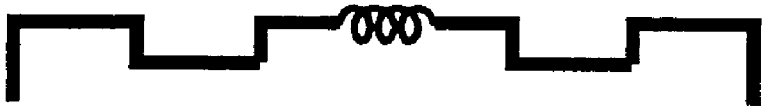
FIG. 9D is a configuration diagram of a parasitic element according to the third embodiment of the present invention.

Similarly, FIG. 9B to FIG. 9D show the linear parasitic elements of FIG. 4 to FIG. 6 changed to meander shaped parasitic elements.

Thus according to the parasitic element of the third embodiment, the shape of the parasitic element is changed, so that, in addition to achieving the effects of the first embodiment and the second embodiment, it is possible to moderate changes in the impedance characteristics and shorten the length that the parasitic element claims in the width direction of the ground plane.

(Fourth Embodiment)

Figure 10:
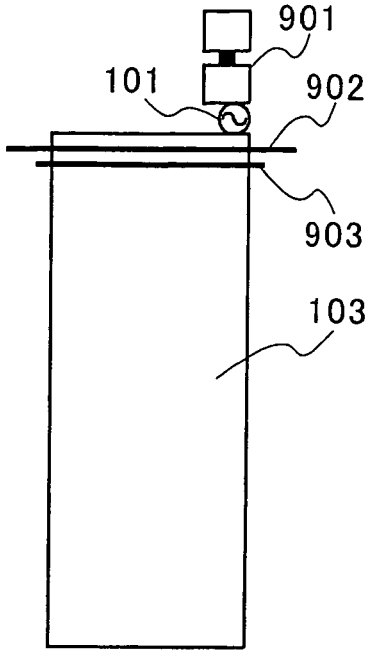
FIG. 10 is a configuration diagram of an antenna apparatus for wireless devices according to the fourth embodiment of the present invention.

A case will be described here with the present embodiment where an antenna element that accommodates a plurality of bandwidths, and parasitic elements are provided. FIG. 4 is a configuration diagram of the antenna apparatus for wireless devices according to the fourth embodiment of the present invention. Parts in FIG. 10 identical to those of FIG. 2 are given the same numerals as in FIG. 2 without further explanation. FIG. 10 differs from FIG. 2 only in that instead of antenna element 102 antenna element 901 that accommodates two frequencies is provided, and in that instead of parasitic element 104 two parasitic elements of 902 and 903 of different lengths are provided.

Antenna element 901, unbalanced-fed from feed point 101, transmits and receives electric waves using the first and second frequencies.

First parasitic element 902 is provided near antenna element 901, approximately parallel to the width direction of the ground plane, and near ground plane 103, and has a length that accommodates the first frequency.

Second parasitic element 903 has a different length than first parasitic element 902 and is provided approximately parallel to first parasitic element 902 and near ground plane 103, and has a length that accommodates a second frequency. Nevertheless, first parasitic element 902 and second parasitic element 903 are each configured in a length to operate as a reflector when provided so as to be on the side of the body with respect to ground plane 103 during talk time, and in a length to operate as a director when provided so as to be on the opposite side from the body with respect to ground plane 103 during talk time.

Next, the operation of the antenna apparatus of the above configuration will be explained. As feed point 101 performs unbalanced feeding to antenna element 901, antenna element 901 radiates electric waves of the first and second frequencies. Thereupon chassis current runs over ground plane 103 and radiation starts from ground plane 103. Then, the parasitic element provided approximately parallel to the width direction of the ground plane operates as a director or as a reflector. By this means, it is possible that the direction of radiation has directivity. If during talk time first parasitic element 902 and second parasitic element 903 are provided so as to be on the side of the body with respect to ground plane 103, first parasitic element 902 and second parasitic element 903 operate as reflectors. If during talk time first parasitic element 902 and second parasitic element 903 are provided so as to be on the opposite side from the body with respect to ground plane 103, first parasitic element 902 and second parasitic element 903 operate as directors. In either case, the direction of radiation will be opposite from the body. First parasitic element accommodates the first frequency and second parasitic element 903 accommodates the second frequency. By this means, it is possible to implement an antenna apparatus for wireless devices that accommodates two frequencies.

Although in the present embodiment two frequencies are used, the present invention is by no means limited to this and can be configured to accommodate more than two frequencies. Moreover, in the present embodiment, it is possible to replace a linear parasitic element with a parasitic element of a band-shape, a helical shape, and a meander shape.

Thus according to the antenna apparatus for wireless devices of the fourth embodiment of the present invention, an antenna element and a parasitic element accommodating a first frequency and an antenna element and a parasitic element accommodating a second frequency are provided, so that, in addition to achieving the effect of the first embodiment, it is possible to implement an antenna apparatus for wireless devices that accommodates a plurality of frequencies.

(Fifth Embodiment)

Figure 11:
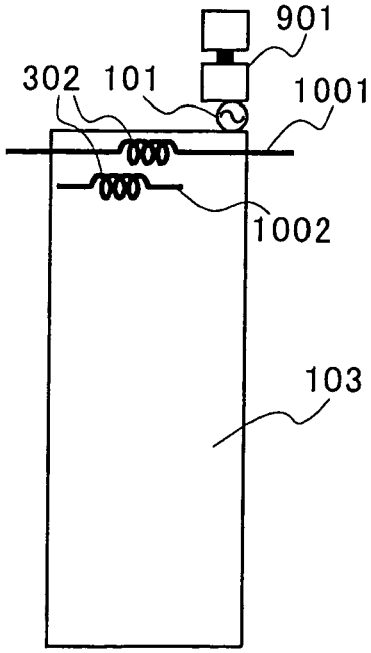
FIG. 11 is a configuration diagram of an antenna apparatus for wireless devices according to the fifth embodiment of the present invention.
Figure 12:
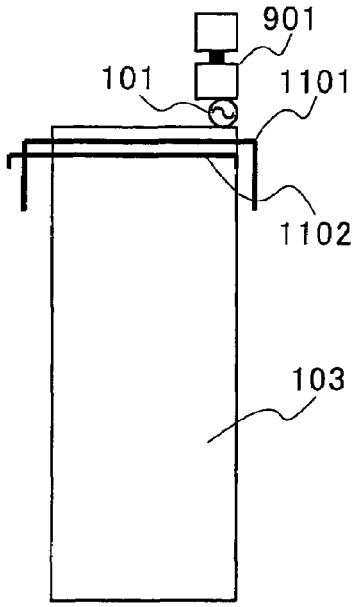
FIG. 12 is a configuration diagram of an antenna apparatus for wireless devices according to the fifth embodiment of the present invention.
Figure 13:
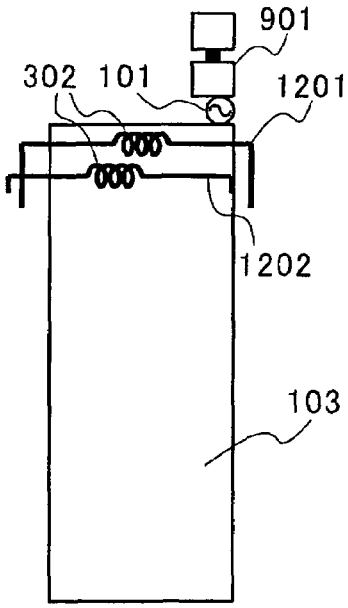
FIG. 13 is a configuration diagram of an antenna apparatus for wireless devices according to the fifth embodiment of the present invention.

FIG. 11, FIG. 12, and FIG. 13 are each a configuration diagram of an antenna apparatus for wireless devices according to the fifth embodiment of the present invention. Parts in the drawings identical to those in FIG. 10 are assigned the same numerals as in FIG. 10 without further explanation.

Referring to FIG. 11, first parasitic element 1001 and second parasitic element 1002 are each installed with inductor 302 in the middle of the element, so as to shorten the element length.

Referring to FIG. 12, first parasitic element 1001 and second parasitic element 1002 are each bent approximately at a right angle at predetermined distance from both ends so as to shorten the length of the width direction and make the configuration simpler than when inductor 302 is installed in the middle of first parasitic element 1001 and second parasitic element 1002 401 such as shown in FIG. 11.

Referring to FIG. 13, indictor 302 is installed in the middle of first parasitic element 1201 and second parasitic element 1202 and moreover first parasitic element 1201 and second parasitic element 1202 are each approximately at a right angle at predetermined distance from both ends, so as to further shorten the length of the width direction of the ground plane.

In the present embodiment, the parasitic elements as shown in FIG. 11 to FIG. 13 are each configured in a length to operate as a reflector when provided so as to be on the side of the body with respect to ground plane 103 during talk time, and in a length to operate as a director when provided so as to be on the opposite side from the body with respect to ground plane 103 during talk time.

Thus according to the antenna apparatus for wireless devices of the fifth embodiment, the inductor is installed in the middle of the parasitic element and the parasitic element is bent approximately at a right angle at predetermined distance from both ends, so that, in addition to achieving the effect of the fourth embodiment, it is possible to shorten the length of the width direction of the ground plane.

(Sixth Embodiment)

Figure 14:
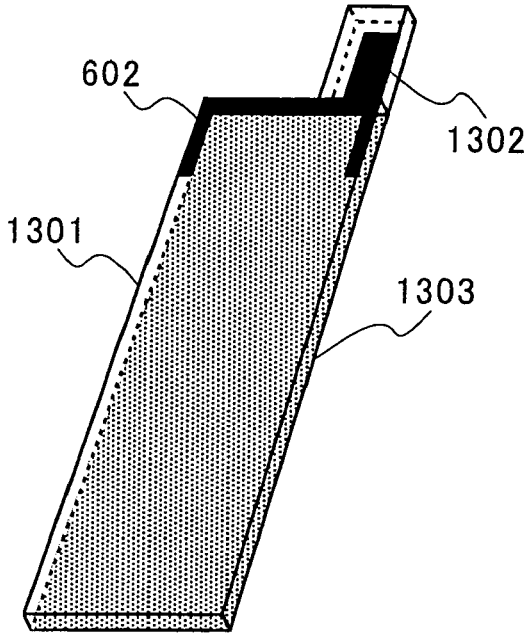
FIG. 14 is a configuration diagram of an antenna apparatus for wireless devices according to the sixth embodiment of the present invention.

FIG. 14 is a configuration diagram of an antenna apparatus for wireless devices according to the sixth embodiment of the present invention. In FIG. 14, antenna element 1302 and ground plane 1303 are printed on base plate 1301.

Antenna element 1302 is printed on base plate 1301, unbalanced-fed from a phantom feed point on ground plane 1303, and transmits and receives electric waves.

Ground plane 1303 is a conductive steel membrane printed on base plate 1301.

Parasitic element 602 has a band shape and is approximately in the form of the letter U, and is stuck on one side of the width direction, and partly along the length direction, of the base plate. Additionally, by sticking parasitic element 602 on the opposite side of the plane on which ground plane 1303 is printed, the direction of radiation of electric waves from ground plane 1303 can be regulated.

Thus according to the antenna apparatus for wireless devices of the sixth embodiment, the antenna element and the ground plane are printed on the base plate and the parasitic element is placed on the opposite side of the printed plane, so that it is possible to configure an antenna apparatus for wireless devices thin and small.

(Seventh Embodiment)

Figure 15:
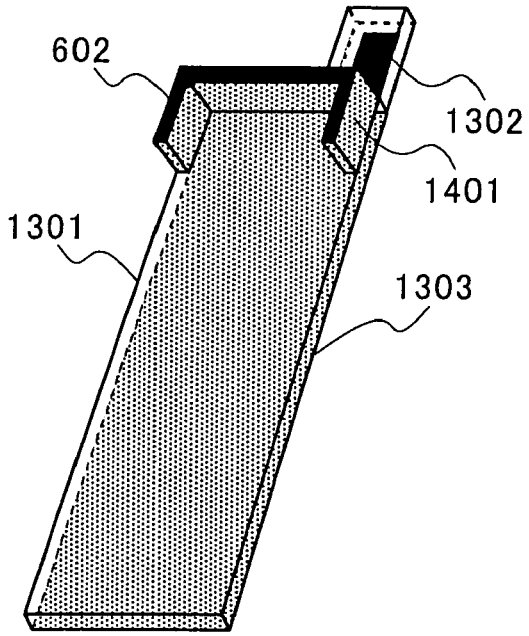
FIG. 15 is a configuration diagram of an antenna apparatus for wireless devices according to the seventh embodiment of the present invention.

FIG. 15 is a configuration diagram of an antenna apparatus for wireless devices according to the seventh embodiment of the present invention. Referring to FIG. 15, parts identical to those in FIG. 14 are assigned the same numerals as in FIG. 14 without further explanation. FIG. 15 differs from FIG. 14 in that dielectric block 1401 is provided between parasitic element 602 and ground plane 1303.

Dielectric block 1401 is band shaped and ⊐shaped, and provided between parasitic element 602 and ground plane 1303 with dielectric constant ∈. By providing this dielectric block 1401, the distance between parasitic element 602 and ground plane 1303 can be shortened compared to when dielectric body 1401 is not provided. Moreover, the length of the width direction and the length direction of parasitic element 602 can be shortened, so that it is possible to configure the antenna apparatus for wireless devices thin and small.

(Eighth Embodiment)

A case will be described here with the present embodiment where the antenna apparatus for wireless devices according to the above-described first embodiment to the seventh embodiment will be installed in mobile telephone apparatus. As an example, a case will be described here where the antenna apparatus for wireless devices according to the first embodiment is installed.

Figure 16:
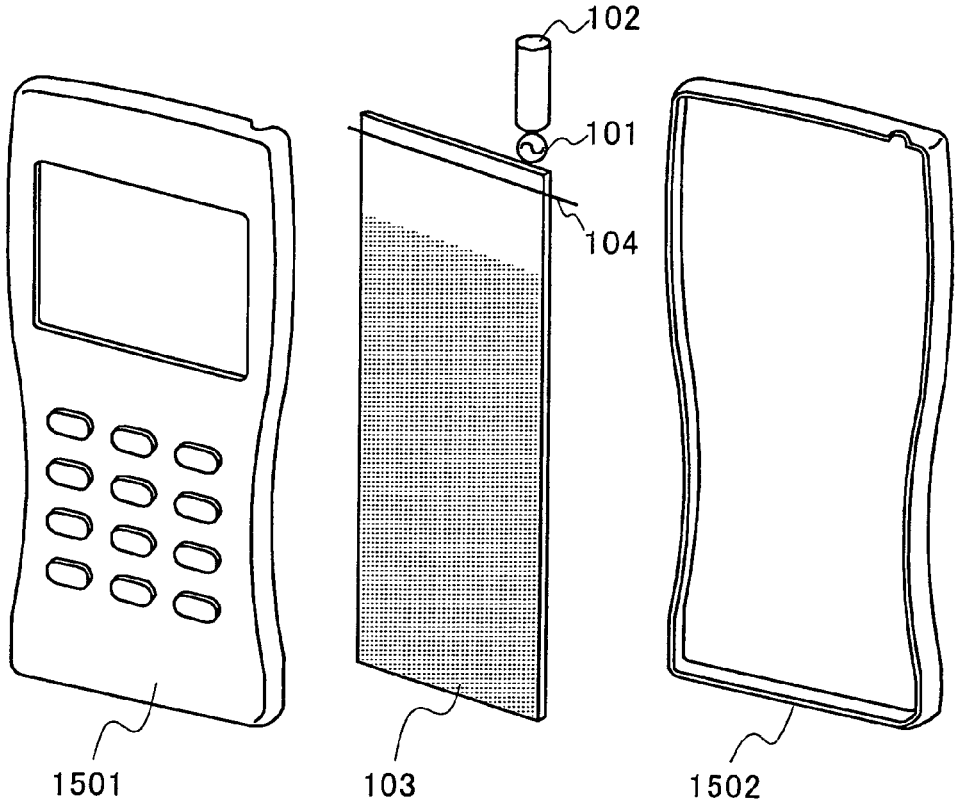
FIG. 16 is an exploded perspective view of a mobile telephone apparatus installed with an antenna apparatus for wireless devices according to the eighth embodiment of the present invention.

FIG. 16 is an exploded perspective view of a mobile telephone apparatus installed with the antenna apparatus for wireless devices according to the first embodiment of the present invention. Referring to FIG. 16, chassis front case 1501 comprises a liquid crystal display and operating buttons. Chassis rear case 1502 integrates with chassis front case 1501 to form a chassis. In the chassis, the antenna apparatus for wireless devices and such are included. Parasitic element 104 is configured in a length to operate as a reflector when provided on the side of the chassis front case with respect to ground plane 103 as shown in the drawing, and configured in a length to operate as a director when provided on the side of the chassis rear case with respect to ground plane 103. By this means, it is possible to reduce radiation to the front of the chassis and improve radiation gain from the rear of the chassis, so as to improve gain and reduce the SAR during talk time.

Thus, the mobile telephone apparatus, the length of which is set depending on whether parasitic element 104 is on the front side of the chassis or the rear side of the chassis, can reduce radiation to the front of the chassis and improve radiation gain from the rear of the chassis while in use for talk near the body. In other words, radiation to the body in front of the chassis can be reduced (the SAR can be reduced)

(Ninth embodiment)

Figure 17:
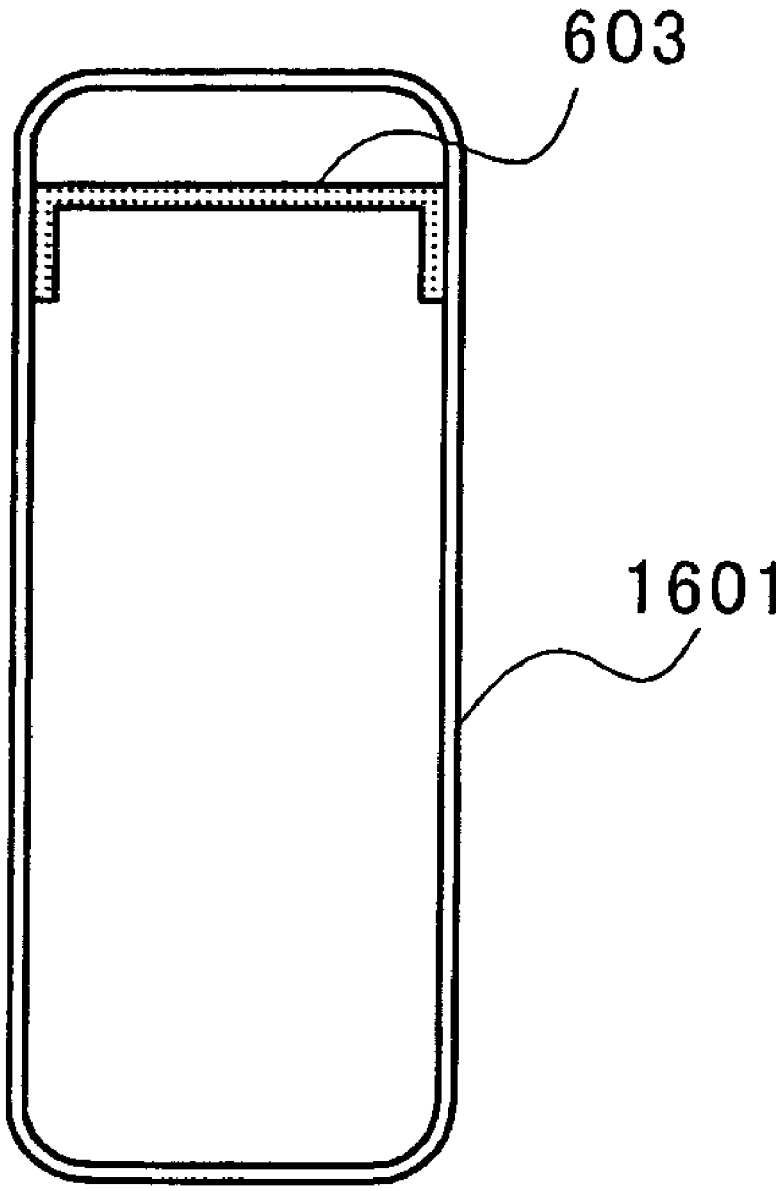
FIG. 17 is a configuration diagram of an antenna apparatus for wireless devices according to the ninth embodiment of the present invention.

FIG. 17 is a configuration diagram of an antenna apparatus according to the ninth embodiment of the present invention. Wireless device case 1601 is a molded product of plastic and such that forms a chassis for a wireless device.

Parasitic element 602 has a band shape and a ⊐shape and is stuck inside the case. By this means, it is possible to implement a thin antenna device for wireless devices in a simple way.

Although each of the above described embodiments describes a case where the circuit board is a rectangle for convenience of description, the present invention is by no means limited to this.

Moreover, each of the above described embodiments describes a case where the ground plane radiates electric waves using the ground of only one plane of the circuit board, the present invention is by no means limited to this and any ground plane can be used as long as it radiates electric waves.

As described above, according to the present invention, a parasitic element is provided near an antenna element and a ground plane, approximately parallel to the width direction of the ground plane, and the parasitic element is configured in a length to operate as a reflector when provided so as to be on the side of the body with respect to the ground plane during talk time and in a length to operate as a director when provided on the opposite side from the body with respect to the ground plane, so that, electric wave radiation to the body side is reduced and the specific absorption rate (SAR) can be thus reduced, and the radiation pattern is turned in directions apart from the body and gain during talk time can be thus improved.

The present application is based on Japanese Patent Application No.2002-051286 filed on Feb. 27, 2002, entire content of which is expressly incorporated herein by reference.

INDUSTRIAL APPLICABILITY

The present invention is applicable to antenna apparatus for wireless devices and suitable for use for potable mobile wireless apparatus.

What is claimed is:

1. An antenna apparatus for wireless devices, comprising:

a ground plane;

an antenna element that has a first resonating point corresponding to a first frequency bandwidth and a second resonating point corresponding to a second frequency bandwidth different from the first frequency bandwidth;

a feeding section that performs unbalanced feeding to the antenna element;

a first parasitic element that is provided near the antenna element and the ground plane and positioned on an opposite side from a body of a user with respect to the ground plane while communication is in progress and that has a length to operate as a director in the first frequency bandwidth; and a second parasitic element that is provided near the antenna element and the ground plane and positioned on the opposite side from the body of the user with respect to the ground plane while communication is in progress and that has a length to operate as a director in the second frequency bandwidth.

2. An antenna apparatus for wireless devices, comprising:

a ground plane;

an antenna element;

a feeding section that performs unbalanced feeding to the antenna element; and a parasitic element that is provided near the antenna element and the ground plane and provided with an inductor in a middle of said parasitic element, and that adopts varying lengths between a case where said parasitic element is positioned on a side of a body of a user with respect to the ground plane while communication is in progress and a case where said parasitic element is positioned on an opposite side from the body of the user with respect to the ground plane while communication is in progress.

3. An antenna apparatus for wireless devices, comprising:

a ground plane;

an antenna element;

a feeding section that performs unbalanced feeding to the antenna element; and a parasitic element that is provided near the antenna element and the ground plane and is bent substantially at a right angle at a predetermined distance from both ends and that adopts varying lengths between a case where said parasitic element is positioned on a side of a body of a user with respect to the ground plane while communication is in progress and a case where said parasitic element is positioned on an opposite side from the body of the user with respect to the ground plane while communication is in progress.

4. The antenna apparatus for wireless devices according to claim 2, wherein the parasitic element is in one of a band shape, a helical shape, and a meander shape.

5. The antenna apparatus for wireless devices according to claim 2, wherein the antenna element and the ground plane are printed on a plane of a base plate and the parasitic element is provided on an opposite plane from the printed plane of the base plate.

6. The antenna for wireless devices according to claim 5, further comprising a dielectric between the parasitic element and the base plate.

7. The antenna apparatus for wireless devices according to claim 2, wherein the parasitic element is configured to attach to a wireless device case.

* * * * *